United States Patent [19]

Gallagher et al.

[11] Patent Number: 4,662,844

[45] Date of Patent: May 5, 1987

[54] COAXIAL MACHINE-GUN/MAIN-TANK-GUN WEAPONS EFFECTS SIMULATOR

[75] Inventors: Lawrence J. Gallagher, Arcadia; Lauren B. Althaus, Montclair; Robert J. Pederson, Thousand Oaks; Benjamin Rubinstein, La Crescenta, all of Calif.

[73] Assignee: Loral Electro-Optical Systems, Inc., Pasadena, Calif.

[21] Appl. No.: 796,655

[22] Filed: Nov. 8, 1985

[51] Int. Cl.[4] ..... G09B 9/00

[52] U.S. Cl. ..... 434/16; 89/7

[58] Field of Search ..... 42/54, 55, 106; 89/1.1, 89/7; 272/14, 20; 273/348.1; 434/11, 16, 19, 21, 22

[56] References Cited

U.S. PATENT DOCUMENTS

| | | | |
|---|---|---|---|
| 2,094,854 | 10/1937 | Smith | 89/7 |
| 2,425,975 | 8/1947 | Witte et al. | 89/7 |
| 4,245,403 | 1/1981 | Hipp | 434/11 |

*Primary Examiner*—Stephen C. Bentley

*Attorney, Agent, or Firm*—Spensley Horn Jubas & Lubitz

[57] ABSTRACT

The invention comprises a combined machine gun and large bore cannon weapons effects signature simulator having a rapid fire small bore methane and oxygen fired combustion chamber disposed within the combustion chamber of a large bore main tank gun weapons effects signature simulator and supplied from a common source of pressurized methane and oxygen.

One embodiment includes the injection of ambient temperature oil into the large bore chamber prior to firing the combustible mixture to augment the flame content of the weapon signature.

Another embodiment provides for the emission of hot oil vapor to augment the smoke content of the weapon signature.

Yet another embodiment provides the machine gun simulator combustion chamber integral with and in intimate thermal contact with the wall of the large bore combustion chamber, whereby the machine gun combustion chamber utilizes the large bore combustion chamber wall to dissipate heat.

Still another embodiment provides a large bore combustion chamber coaxially and distally extending from the distal end of the small bore combustion chamber, whereby the large bore combustion chamber may be filled through the small bore combustion chamber with methane and oxygen, and ignition of all of the combustible mixture is initiated in the small bore combustion chamber.

11 Claims, 4 Drawing Figures

COAXIAL MACHINE-GUN/MAIN-TANK-GUN WEAPONS EFFECTS SIMULATOR

BACKGROUND OF THE INVENTION

A number of combat vehicles, such as tanks, are equipped with a large bore cannon and a machine gun that are aimed and by a common sight and may be fired independently or simultaneously. Such weapons systems are in generally in use, and are known as "coax guns" that, except for a very small parallax offset, fire on the same aiming axis.

Prior art weapons effects simulators using gas and oxidizer combustion to produce the sound and flash of the weapons have been devised separately for both machine guns and large bore cannons, and such simulators are presently in use. Since the fuel and oxidizer supplies, regulators, and many power and timing functions are identical for both types of weapons, it is desireable from the viewpoints of both cost and reliability to combine the two weapons effects simulators into a single unit sharing common components to the greatest extent possible.

Prior art weapons effects simulators have also not been capable of producing the magnitude of visible flash and volume of smoke produced by firing live ammunition large bore rounds from cannons.

There is also a need for producing substantial amounts of smoke for realistic indication of a vehicle disablement in combat traing scenarios. Prior art smoke generators are extremely large and complex, and do not respond instantaneously with sufficient smoke to provide the necessary realism.

SUMMARY OF THE INVENTION

It is the primary purpose of the present invention to provide a weapons effects signature simulator for a large bore cannon that includes a machine gun effects simulator, whereby the combined simulator is simpler and less costly than the two separate simulators.

It is a further purpose of the invention to provide a cannon weapons effects signature simulator having improved capability to generate smoke and flash associated with the firing of large bore rounds.

It is also a further purpose of the present invention to provide a weapons effects signature simulator that also has the capacility to instantaneously produce a large volume of smoke to indicate a vehicle disablement.

The present invention achieves the foregoing purposes of the invention by providing a machine gun weapons effects signature simulator having a methane and oxygen powered combustion chamber for the machine gun simulator disposed within the combustion chamber of a large bore main tank gun weapons effects signature simulator, powered from a common source of pressurized and regulated methane and oxygen, and sharing an electronic timing and control system.

The present invention also includes the injection and combustion of fuel oil into the large bore cannon combustion chamber to enhance the production of muzzle flash, and further includes the emission of hot oil, without ignition, to produce large volumes of smoke. Both could and hot fuel oils are injected through solenoid valves from a reservoir that is pressurized by the regulated methane gas supply pressure.

In one embodiment, the machine gun simulator combustion chambers are disposed integrally with and in intimate thermal contact with the wall of the large bore combustion chamber, whereby the machine gun combustion chamber utilizes the large bore combustion chamber wall to dissipate heat.

In another embodiment the machine gun simulator combustion chambers feed into a large bore combustion chamber, permitting the filling of the large bore chamber with combustible mixture from the machine gun combustion chambers, and ignition of the mixture in the machine gun chamber propagates into and detonates the large bore chamber charge.

DETAILED DESCRIPTION OF THE DRAWINGS

Figure 1:
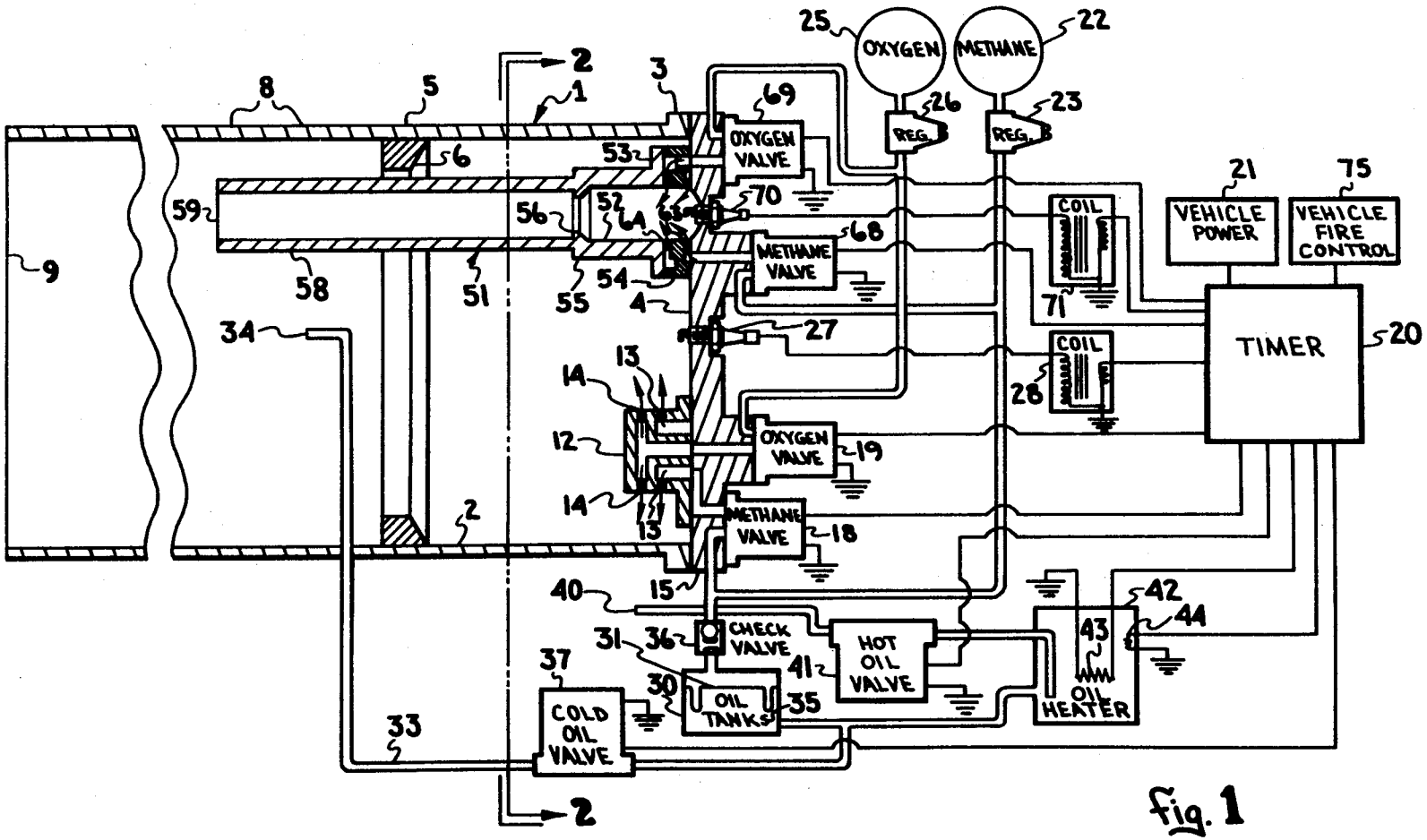
FIG. 1 is a schematic cross-sectional view of a weapons effects signature simulator according to the invention, taken along a longitudinal centerline.

In FIG. 1 a weapons effects signature simulator 1 according to the present invention is shown having a cannon weapons effects simulator primary combustion chamber 2 of generally tubular shape, having a proximal end 3 closed by a head wall 4, and a distal end 5 terminating in a convergent, annular conical ring 6. A secondary combustion chamber 8, also of generally tubular shape, extends from the conical ring 6 to an open distal end 9. A fuel/oxidizer injector 12 injects a combustible mixture of methane gas and oxygen into the primary combustion chamber 2 at greater than sonic velocities through a number of circumferentially spaced methane nozzles 13 and oxygen nozzles 14, through a manifold plate 15, which is supplied through a methane solenoid valve 18 and an oxygen solenoid valve 19, respectively. The sonic velocities expand supersonically into the primary combustion chamber, followed by a supersonic shock system breakdown, thereby providing highly turbulent mixing of fuel and oxidizer. Pulse-fed slugs of methane gas are injected into combustion chamber 2 when the methane solenoid valve 18 is energized by a timer 20 from a source of vehicle power 21, allowing the flow of methane gas from a methane supply pressure tank 22 through a pressure regulator 23. Pulse-fed slugs of oxygen are similarly injected into combustion chamber 2 when the oxygen solenoid valve 19 is energized by timer 20 from a source of vehicle power 21, allowing the flow of oxygen from an oxygen supply pressure tank 25 through a pressure regulator 26. A spark plug 27 is shown connected to an ignition coil 71, which is operated to ignite the mixture of methane and oxygen in the combustion chamber.

Since the detonative combustion of methane and oxygen does not produce enough flash and smoke to accurately simulate a large bore cannon firing, additional flash and smoke is provided by injecting cold (ambient temperature) oil into combustion chamber 2 prior to ignition through a cold oil nozzle 34 supplied by an oil line 33, extending from an oil tank 30. Oil tank 30 contains a supply of oil 35 which is maintained under pressure by the application of methane gas, through a check valve 36, from the methane gas pressure regulator 23. To preclude oil foaming by absorption of methane by the oil, the methane and oil are separated by an accumulator diaphragm 31. and protected from backflow by check valve 36. The cold oil is injected by the operation of a solenoid valve 37, energized by timer 20.

Further augmentation of the smoke is accomplished by the emission of hot oil through hot oil nozzle 40 after ignition of the combustible mixture. Hot oil is supplied through manifold at a temperature between 500 and 1000 degrees Fahrenheight, controlled by the hot oil solenoid valve 41 through the oil heater 42 from the pressurized oil tank 43. The temperature of the oil is maintained by an electrical heater 43 with timer 20 sensing the temperature of a thermocouple 44 and controlling heater energy from vehicle power 21. Experience has shown the need to minimize the line lengths and heat losses between the oil heater 42 and the nozzle 40 to preclude condensation of the oil vapor. The hot oil can augment smoke of a simulated fired round, or the smoke may be initiated independently to indicate a disabled vehicle in training scenarios.

A coax machine gun effects simulator 51 is provided within the cannon combustion chambers 2 and 8 with a smaller combustion chamber 52, having a proximal end 53 disposed against an injector means 54 contiguous with the manifold plate 4, and a distal end terminating in an annular convergent conical ring 56. A secondary combustion chamber 58 is provided having a proximal end at conical ring 56 and extending in the form of an elongated tube to an open distal end 59. Injector 54 supplies pressurized methane gas at greater than sonic velocities through a number of circumferentially spaced nozzles 63, and supplies pressurized oxygen at greater than sonic velocities through a number of circumferentially spaced nozzles 64. Pulse-fed slugs of methane gas are injected into combustion chamber 52 when the methane solenoid valve 68 is energized by timer 20 from the source of vehicle power 21, allowing the flow of methane gas from methane supply pressure tank 22 through pressure regulator 23. Pulsefed slugs of oxygen are similarly injected into combustion chamber 52 when the oxygen solenoid valve 69 is energized by timer 20 from source of vehicle power 21, allowing the flow of oxygen from oxygen supply pressure tank 25 through pressure regulator 26. A spark plug 70 is shown connected to an ignition coil 71, which is operated to ignite the mixture of methane and oxygen in the combustion chamber. Control of all of the timing functions are provided by a fire control means 75, electrically connected to the timer and installed in the host vehicle.

Figure 2:
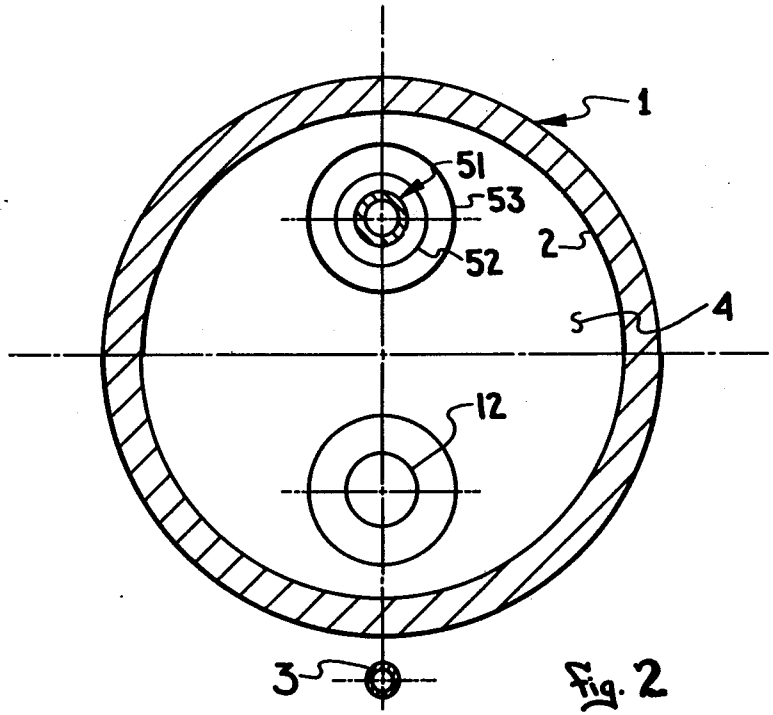
FIG. 2 is a cross-sectional view of the weapons effects signature simulator of FIG. 1, taken along section lines 2—2 of FIG. 1.

In FIG. 2 a cross-sectional view is shown, taken along line 2—2 of FIG. 1, in which the coax machine gun weapons effects simulator 51 is shown with its machine gun primary combustion chamber 52 mounted to head wall 4 within the cannon primary combustion chamber 2. The cannon fuel/oxidizer injector 12 is also shown within primary combustion chamber 2.

Figure 3:
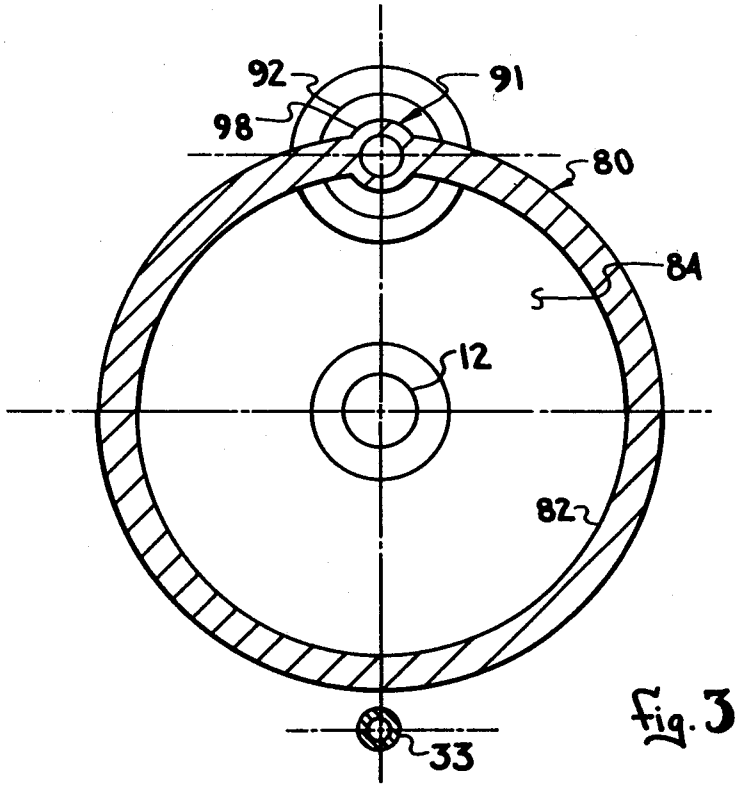
FIG. 3 is a cross-sectional view of an alternate embodiment of a weapons effects signature simulator according to the invention.

In FIG. 3 an alternate embodiment of the present invention is show in which the weapons effects signature simulator 80 is shown in a cross sectional view and having a cannon fuel oxidizer injector 12 mounted to headwall 84. A Coax machine gun weapons effects simulator 91 is shown having its primary combustion chamber 92 and its secondary combustion chamber 98 integral with, and in intimate thermal contact with the wall of cannon primary combustion chamber 82.

Figure 4:
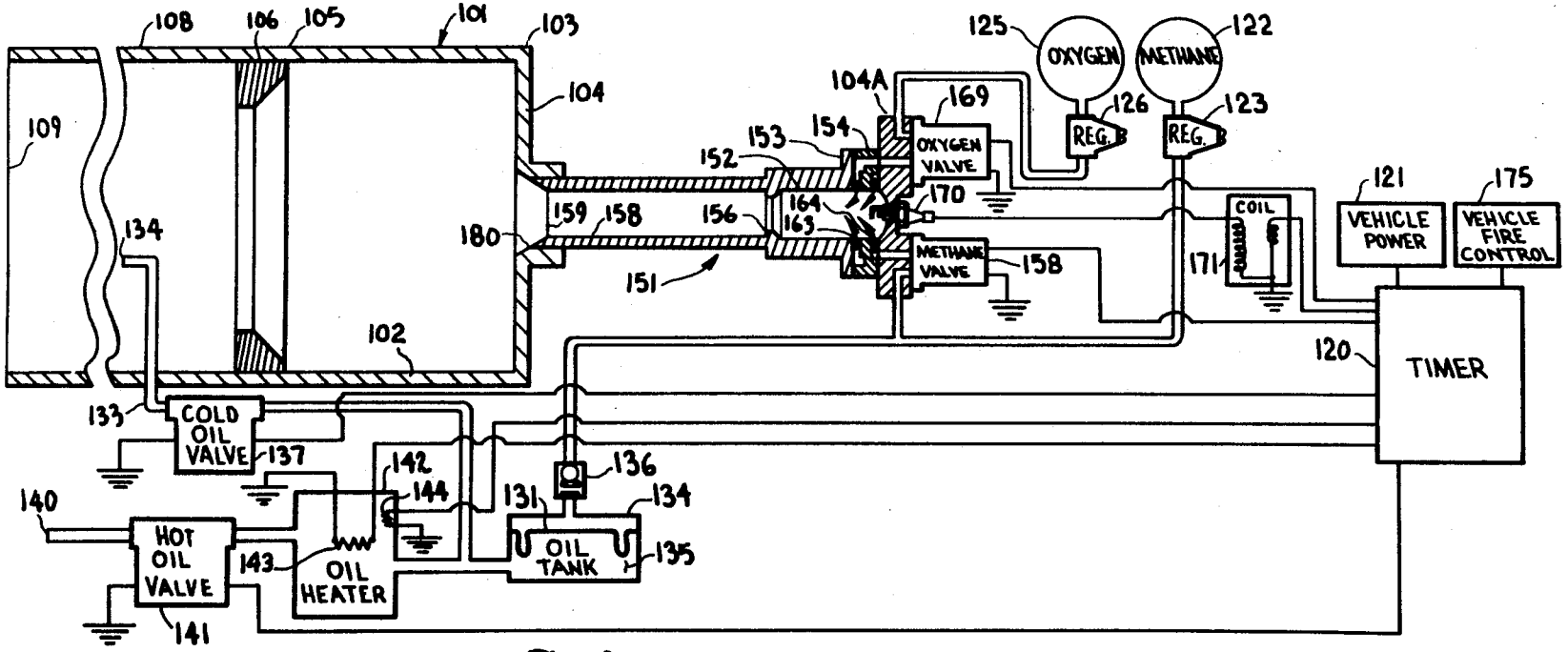
FIG. 4 is a scematic cross-sectional view of another alternate embodiment of a weapons effects signature simulator according to the invention, taken along a longitudinal centerline.

In FIG. 4 a weapons effects signature simulator 101 according to the present invention is shown having a cannon weapons effects simulator primary combustion chamber 102 of generally tubular shape, having a proximal end 103 closed by a head wall 104, and a distal end 105 terminating in a convergent, annular conical ring 106. A secondary combustion chamber 108, also of generally tubular shape, extends from the conical ring 106 to an open distal end 109. A coax machine gun effects simulator 151 is provided coaxially with the cannon primary combustion chamber 102 and secondary combustion chamber 108, with a smaller machine gun combustion chamber 152, having a proximal end 153 disposed against an injector means 154 contiguous with the manifold plate 104A, and a distal end terminating in an annular convergent conical ring 156. A secondary machine gun combustion chamber 158 is provided having a proximal end at conical ring 156 and extending in the form of an elongated tube to an open distal end 159. Injector 154 supplies pressurized methane gas at greater than sonic velocity through a number of circumferentially spaced nozzles 163, and supplies pressurized oxygen at greater than sonic velocity through a number of circumferentially spaced nozzles 164. Pulse-fed slugs of methane gas are injected into combustion chamber 152 when the methane solenoid valve 158 is energized by timer 120 from the source of vehicle power 121, allowing the flow of methane gas from methane supply pressure tank 122 through pressure regulator 123. Pulse-fed slugs of oxygen are similarly injected into combustion chamber 152 when the oxygen solenoid valve 169 is energized by timer 120 from source of vehicle power 121, allowing the flow of oxygen from oxygen supply pressure tank 125 through pressure regulator 126. A spark plug 170 is shown connected to an ignition coil 171, which is operated to ignite the mixture of methane and oxygen in the combustion chamber. All of the firing mode functions are initiated by a fire control means 175, electrically connected to the timer 120 and installed in the host vehicle.

Since the methane and oxygen combustion does not produce enough flash and smoke to accurately simulate a large bore cannon firing, additional flash and smoke is provided by injecting cold (ambient temperature) oil into the secondary combustion chamber 108, prior to ignition, through a cold oil nozzle 134 supplied by passage 133. A supply of oil 135 which is maintained under pressure by the application of methane gas 122 from the methane gas pressure regulator 123, through a check valve 136, To preclude oil foaming by absorption of methane by the oil, the methane and oil are separated by an accumulator diaphragm 131. The cold oil is injected by the operation of a cold oil (ambient temperature) solenoid valve 137, energized by timer 120.

Further augmentation of the smoke is accomplished by the emission of hot oil through hot oil nozzle 140 after ignition of the combustible mixture. Hot oil is supplied through manifold at a temperature between 500 and 1000 degrees Fahrenheight, controlled by the hot oil solenoid valve 141 through the oil heated-142 from the pressurized oil tank 134. The temperature of the oil is maintained by an electrical heater 143 with timer 120 sensing the temperature of a thermocouple 144 and controlling heater energy from vehicle power 121. Experience has shown the need to minimize the line lengths and heat losses between the oil heater 142 and the nozzle 140 to preclude condensation of the oil vapor. The hot oil can augment smoke of a simulated fired round, or the smoke may be initiated independently to indicate a disabled vehicle in training scenarios.

The rapid firing rate of a machine gun weapons effect is produced by cyclic timing of the opening of the methane solenoid valve 158, oxygen solenoid valve 169, and spark plug 170 energized by the ignition coil 171, all sequenced by timer 120 to produce detonative combustion wavews that create high velocity energy projected from the distal end 159 of the secondary combustion chamber 158. This is described in more detail in our co-pending patent application entitled: SURROGATE WEAPON FOR WEAPONS EFFECTS SIGNATURES Ser. No. 067793,671.

In order to produce the weapons effects signature of the large bore cannon, the same components are cycled more slowly, wherein the methane and oxygen in a combustible mixture flow a relatively low velocities through the primary and secondary combustion chambers 152 and 158, respectively to fill the primary combustion chamber 102 of the large bore cannon simulator 101. An annular ring 106 causes recirculation currents in the methane/oxygen mixture to held retain the mixture in the primary combustion chamber 102 prior to ignition.

Primary combustion chamber 102 has a headwall 104 at a proximal end, which is contiguous with the distal end 159 of the secondary combustion chamber 158 of the machine gun weapons effects simulator 151. Distal end 159 of secondary combustion chamber 158 has a divergent nozzle 180 to create spreading of the low velocity methane/oxygen mixture flow in order to make the recirculating effect of the conical ring 106 more effective. When primary combustion chamber 102 is substantially filled with a combustible mixture the timer 120 closes the methane and oxygen valves 158 and 169, respectively, and ignites the mixture near spark plug 170; The combustion propagates through the primary and secondary combustion chambers 152 and 158 of the machine gun weapons effects signature simulator 151, and detonatively combusts the methane/oxygen mixture in the large bore primary combustion chamber 102, thereby simulating the acoustic signature of the large bore cannon by propagating the combustion waves through the distal end 109 of the secondary combustion chamber 108.

We claim:

1. A weapons effects signature simulator for a large bore cannon and coaxial machine gun including:

a large bore primary combustion chamber in the form of an elongated tubular cavity having a proximal end closed with a head wall and an open distal end terminating in an annular convergent ring;

a large bore secondary combustion chamber of generally tubular form extending from the annular convergent ring of the primary combustion chamber and having an open distal end;

a pressurized and regulated supply of methane and oxygen connected to a methane manifold and an oxygen manifold passing through the head wall of the primary combustion chamber;

an injector connected to the methane and oxygen manifolds and comprising a plurality of methane nozzles and a plurality of oxygen nozzles radially injecting and mixing methane and oxygen in timed pulses into the primary combustion chamber;

a means for injecting ambient temperature fuel oil into the secondary combustion chamber;

an ignition means timed after the start of methane and oxygen injection to initiate combustion in the primary combustion chamber and propagate combustion of the methane and oxygen mixture through the primary combustion chamber and into the secondary combustion chamber to additionally combust the fuel oil in the secondary combustion chamber to augment the smoke and flash of the weapons effect signature;

a trigger means to initiate the timed pulse sequence from a timer having an external source of electrical power, to inject and ignite the methane and oxygen mixture; and in which a small bore, rapid-fire machine gun weapon effects simulator is disposed within the large bore cannon weapon effects combustion chambers.

2. A weapons effects signature simulator for a large bore cannon and coaxial machine gun including:

a primary small bore combustion chamber in the form of an elongated tubular cavity having a proximal end closed with a head wall and an open distal end terminating in an annular convergent ring;

a secondary small bore combustion chamber of generally tubular form extending from the annular convergent ring of the primary combustion chamber and having an open distal end;

a methane manifold and an oxygen manifold connected to a pressure regulated supply of methane and oxygen, respectively, through methane and oxygen solenoid valves, respectively, and passing through the head wall of the small bore primary combustion chamber;

an injector connected to the methane and oxygen manifolds and comprising a plurality of methane nozzles and a plurality of oxygen nozzles radially injecting and mixing methane and oxygen in timed pulses into the small bore primary combustion chamber;

a large bore primary combustion chamber of generally tubular configuration, having a proximal end terminating in a head wall contiguous with the distal end of the small bore secondary combustion chamber and extending coaxially to a distal end provided with an annular convergent ring;

a large bore secondary combustion chamber of generally tubular elongated configuration, having a proximal end contiguous with the annular ring of the large bore primary combustion chamber, and an open distal end;

an ignition means within the small bore primary combustion chamber and timed to operate timed after the start of methane and oxygen injection to initiate combustion in the small bore primary combustion chamber;

a timing means operating the methane and oxygen solenoid valvs and the ignition means from an external source of electrical power;

a first optional timed pulse sequence operating the ignition means after the injection of a combustible mixture of methane and oxygen into the small bore primary combustion chamber;

a second optional timed pulse sequence operating the ignition means after the injection of a combustible mixture of methane and oxygen through the primary and secondary small bore combustion chambers and substantially filling the large bore primary combustion chamber with the combustible mixture;

a trigger means to initiate either timed pulse sequence from a timer to inject and ignite the methane and oxygen mixture; and a means for injecting ambient temperature fuel oil into the large bore secondary combustion chamber.

3. A weapons efects signature simulator according to claim 1 in which the ambient temperature fuel oil is injected prior to ignition of the methane and oxygen mixture ignition to enhance the flash of the signature.

4. A weapons effects signature simulator according to claim 1 in which hot fuel oil at a temperature of 500 to 1000 degees Fahrenheight is emitted adjacent to the large bore combustion chambers to produce additional smoke.

5. A weapons effects simulator according to claim 3 in which the hot fuel oil is supplied from a reservoir in which the pressurized oil is heated prior to injection into the combustion chamber.

6. A weapons effects simulator according to claim 3 in which the ambient temperature oil and hot oil are provided from a common tank which is pressurized by the methane fuel supply regulator.

7. A weapons effeects simulator according to claim 4 in which the hot oil may be emitted to produce smoke only, without injecting or igniting methane and oxygen or ambient temperature oil.

8. A weapons effects simulator according to claim 1 in which the small bore, rapid fire combustion chamber includes:

a primary combustion chamber in the form of an elongated tubular cavity having a proximal end closed with a head wall comprising a portion of the cannon simulator head wall and an open distal end terminating in an annular convergent ring;

a secondary combustion chamber of generally tubular form extending from the annular convergent ring of the primary combustion chamber and having an open distal end;

a methane manifold and an oxygen manifold connected to the regulated supply of methane and oxygen for the cannon simulator and passing through the head wall of the primary combustion chamber;

an injector connected to the methane and oxygen manifolds and comprising a plurality of methane nozzles and a plurality of oxygen nozzles radially injecting and mixing methane and oxygen in timed pulses into the primary combustion chamber;

an ignition means timed after the start of methane and oxygen injection to initiate combustion in the primary combustion chamber; and a trigger means to initiate the timed pulse sequence from a timer to inject and ignite the methane and oxygen mixture;

9. A weapons effects simulator according to claim 1 in which the small-bore, rapid-fire combustion chamber is in intimate thermal contact with the wall of the large-bore cannon weapon effects simulator combustion chamber, whereby heat generated by the operation of the small bore combustion chamber is transferred to the walls of the large bore combustion chamber.

10. A weapons effects simulator according to claim 9 in which the small-bore combustion chamber is integral with the walls of the large bore combustion chamber.

11. A weapons effects signature according to claim 1 in which the ambient temperature fuel oil is injected prior to ignition of the methane and oxygen mixture ignition to enhance the flash of the signature, and hot fuel oil at a temperature of 500 to 1000 degees Fahrenheight is emitted after ignition of the methane, oxygen and ambient temperature oil, to enhance the smoke of the signature.

* * * * *